US008974639B2

(12) United States Patent
Gauss et al.

(10) Patent No.: US 8,974,639 B2
(45) Date of Patent: Mar. 10, 2015

(54) ANGLE AND HEIGHT CONTROL MECHANISMS IN FOURDRINIER FORMING PROCESSES AND MACHINES

(71) Applicant: IBS of America, Chesapeake, VA (US)

(72) Inventors: Alex Gauss, Chesapeake, VA (US); Hermann M. Vogl, Chesapeake, VA (US); Joshua N. Kruger, Virginia Beach, VA (US); Michael Boehmer, Virginia Beach, VA (US); Andrew S. Forester, Schoolcraft, MI (US); James F. Faufau, Alpharetta, GA (US)

(73) Assignee: IBS of America, Chesapeake, VA (US)

( * ) Notice: Subject to any disclaimer, the term of this patent is extended or adjusted under 35 U.S.C. 154(b) by 0 days.

(21) Appl. No.: 13/987,132

(22) Filed: Jul. 1, 2013

(65) Prior Publication Data

US 2014/0216675 A1 Aug. 7, 2014

Related U.S. Application Data

(60) Provisional application No. 61/849,804, filed on Feb. 4, 2013.

(51) Int. Cl.
*D21F 1/20* (2006.01)
*D21F 1/36* (2006.01)
*D21F 1/48* (2006.01)

(52) U.S. Cl.
CPC . *D21F 1/36* (2013.01); *D21F 1/483* (2013.01)
USPC ..... 162/352

(58) Field of Classification Search
CPC ..... D21F 1/486; D21F 1/26; D21F 1/80; D21F 1/483; D21F 7/00; D21F 9/003; D21F 1/20; D21F 1/36
USPC ..... 162/348–352
See application file for complete search history.

(56) References Cited

U.S. PATENT DOCUMENTS

| | | | | |
|---|---|---|---|---|
| 3,017,930 | A * | 1/1962 | Dunlap | 162/352 |
| 3,323,982 | A * | 6/1967 | Hill | 162/352 |
| 3,520,775 | A * | 7/1970 | Truxa | 162/352 |
| 3,535,201 | A * | 10/1970 | Reynolds et al. | 162/352 |

(Continued)

FOREIGN PATENT DOCUMENTS

| | | | |
|---|---|---|---|
| DE | 4440944 | A1 | 6/1995 |
| EP | 539027 | A2 * | 4/1993 |

(Continued)

OTHER PUBLICATIONS

Extended European Search Report, Application No. 14153883.5 mail date Apr. 28, 2014.

(Continued)

*Primary Examiner* — Jose Fortuna
(74) *Attorney, Agent, or Firm* — The Dobrusin Law Firm, P.C.

(57) ABSTRACT

Improved height and angle adjustment mechanisms and methods for producing paper includes a plurality of height and angle adjustment mechanisms arranged in the forming or wet section of a Fourdrinier. Glide shoes and cam-blocks having sloped grooves are arranged to be driven within a recess of an upper pultrusion assembly to change the angle or height of a particular foil blade. Actuators extend or withdraw a connecting rod, coupled to the cam-blocks, to influence heights and angles of various foils blades.

32 Claims, 5 Drawing Sheets

(56) References Cited

U.S. PATENT DOCUMENTS

| | | | | |
|---|---|---|---|---|
| 3,573,159 | A | 3/1971 | Sepall | |
| 3,647,620 | A * | 3/1972 | Truxa | 162/211 |
| 3,922,190 | A | 11/1975 | Cowan | |
| 4,184,915 | A * | 1/1980 | Metcalf | 162/352 |
| 4,416,731 | A * | 11/1983 | Pesonen et al. | 162/308 |
| 4,559,105 | A * | 12/1985 | Sennett et al. | 162/352 |
| 4,838,996 | A | 6/1989 | Kallmes | |
| 5,080,760 | A | 1/1992 | Smith et al. | |
| 5,169,500 | A | 12/1992 | Mejdell | |
| 5,735,330 | A * | 4/1998 | Buchmann et al. | 162/301 |
| 5,830,322 | A | 11/1998 | Cabrera y Lopez Caram et al. | |
| 5,922,173 | A | 7/1999 | Neun et al. | |
| 5,951,823 | A | 9/1999 | Cabrera y Lopez Caram et al. | |
| 6,030,501 | A | 2/2000 | Neun et al. | |
| 6,126,786 | A | 10/2000 | White et al. | |
| 6,478,928 | B1 * | 11/2002 | Sbaschnigg et al. | 162/203 |
| 6,982,025 | B2 | 1/2006 | Pitt | |
| 6,988,018 | B2 | 1/2006 | Eames | |
| 7,993,492 | B2 | 8/2011 | Cabrera y Lopez Caram et al. | |
| RE43,679 | E | 9/2012 | VanEssen et al. | |
| 8,551,293 | B2 * | 10/2013 | Faufau et al. | 162/208 |
| 8,685,209 | B2 * | 4/2014 | Faufau et al. | 162/348 |
| 2002/0066546 | A1 * | 6/2002 | Forester | 162/352 |
| 2003/0116295 | A1 | 6/2003 | Eames | |
| 2003/0136539 | A1 * | 7/2003 | Bartelmuss et al. | 162/352 |
| 2005/0150627 | A1 | 7/2005 | Frawley et al. | |
| 2011/0186254 | A1 | 8/2011 | Cabrera y Lopez Caram et al. | |
| 2012/0267065 | A1 * | 10/2012 | Faufau et al. | 162/209 |
| 2013/0042987 | A1 | 2/2013 | Cabrera y Lopez Caram et al. | |
| 2014/0034261 | A1 * | 2/2014 | Faufau et al. | 162/351 |
| 2014/0202648 | A1 * | 7/2014 | Faufau et al. | 162/209 |
| 2014/0216675 | A1 * | 8/2014 | Gauss et al. | 162/348 |
| 2014/0216676 | A1 * | 8/2014 | Gauss et al. | 162/348 |

FOREIGN PATENT DOCUMENTS

| | | | |
|---|---|---|---|
| WO | 2007/088456 | A1 | 8/2007 |
| WO | 2008/118303 | A1 | 10/2008 |

OTHER PUBLICATIONS

Pruitt, M., "How fourdrinier table control affects strength and speed on linerboard—Green Bay Packaging's Morriton, AR, mill" Nov. 30, 2008, available at: http://www.risiinfo.com/magazines/November/2008/PP/PPMagNovember-How-fourdrinier-table-control-affects-strength-and-speed-on-linerboard.html, last accessed Mar. 20, 2013.

IBS Paper Performance Group, Product Brochure, 2005.

Potentially Related Patent, U.S. Appl. No. 13/506,470, filed Apr. 21, 2012, Patent No. 8,551,293.

Potentially related Application, U.S. Appl. No. 14/039,236, filed Sep. 27, 2013.

Office Action for U.S. Appl. No. 14/159,779, dated Aug. 5, 2014.

* cited by examiner

ANGLE AND HEIGHT CONTROL MECHANISMS IN FOURDRINIER FORMING PROCESSES AND MACHINES

The present application relates to U.S. Provisional Patent Application Ser. 61/849,804 filed on Feb. 4, 2013 and claims priority therefrom.

The present application was not subject to federal research and/or development funding.

TECHNICAL FIELD

Generally, the invention relates to improved methods and mechanisms for dewatering paper webs. More specifically, the inventions are improved processes and machines, which produce better paper quality at reduced production costs and increased energy efficiencies. The improved methods and machines include devices that are arranged in the forming or wet section of a Fourdrinier paper machine, hereinafter referred to as a "Fourdrinier." The devices are adjusted via actuators, which may be manually operated by means of manual actuators or with motors controlled through a programmable microprocessor. The term motors should be construed to include electric, pneumatic, hydraulic, and the like.

For purposes of this application, the term "machine direction" with respect to the Fourdrinier extends from the front "wet" end to the rear "dry" end. "Cross-machine direction" extends from one side of the paper machine to the opposite side thereof. In the present invention, a pair of sloped grooves on opposite sides of a moving cam-block is oriented in the cross-machine direction and driven from side-to-side in the cross-machine direction to either adjust an angle or a height of a foil blade for improved dewatering purposes. For purposes of this application, the term "pultrusion" refers to a manufacture of composite materials having a constant cross-section. Likewise, the terms "leading edges" and "trailing edges" used with respect to the term cam-block refers to the left and right sides of the cam-block when viewed from either side of the Fourdrinier and are referenced with the sheet direction of the forming paper.

BACKGROUND OF THE INVENTION

The forming or wet section of a Fourdrinier consists mainly of the head box and the forming wire, or fabric. Its main purpose is to generate consistent slurry, or paper pulp, for the forming wire. A breast roll, several foils, suction boxes and a couch roll commonly make up the rest of the forming section. The press section and dryer section follow the forming section to further remove water from the paper sheet. The paper pulp is deposited atop the forming wire or a forming fabric. The pulp is then dewatered to create a paper sheet.

Adjustable foils have been utilized previously for dewatering operations in Fourdrinier machines. For instance, U.S. Pat. No. 5,169,500 to Mejdell, incorporated by reference thereto, discloses an angle adjustable foil for a paper making machine. In Mejdell, a rigid foil member is pivoted by a cam-actuated adjustment mechanism to change the angle of the foil blade. This tends to move the foil blade in the cross-machine direction which opens a gap between the wet paper stock and the foil blade. The opened gap causes a loss of vacuum on the paper sheet. An aim of the present invention is to overcome this inefficiency.

BRIEF SUMMARY OF THE INVENTION

The improved devices of the present mechanism includes an upper pultrusion assembly arranged atop a lower pultrusion assembly to create a recess which contains a plurality of parts arranged therein to yield an adjustment mechanism. The adjustment mechanism includes cam-blocks, an actuator and associated couplers, guide keys, a connecting rod and glide shoes. Each cam-block includes a pair of inclined planar grooves and rides atop a glide shoe such that the cam-blocks may be slid toward a driven end or in an opposite direction to adjust either the height of a respective foil or an angle of a respective foil, according to whether the sloped grooves are utilizing the same angle, or different angles. Each planar groove includes an open side to allow the fasteners of the guide key to pass there through. One of the inclined grooves is provided on a first face of the cam-block; the other inclined groove is arranged on an opposite face of the cam-block. Guide keys are affixed on an interior surface of the upper pultrusion and extend into the inclined grooves to communicate with the cam-blocks and raise/lower or adjust and angle of the upper pultrusion as the cam-blocks move in a respective direction. Thus, the invention may be realized as two separate embodiments; one for adjusting a foil height when the slopes of the inclined grooves present on the sides of the cam-blocks are equal and the other for adjusting a foil angle when the slopes of the inclined grooves on the front and trailing edges of the cam-blocks are unequal. That is, the rate of change of the front and trailing edges are equal when the cam-blocks are driven from one side to the other side of the Fourdrinier. For ease in understanding the invention, it should be recognized that the upper pultrusions 25A, 25B may be referred to as the upper pultrusion 25. Differences and commonalities in operation and working components of each are discussed below.

An actuator forming part of the improved adjustment mechanism is arranged at one end of the lower pultrusion assembly and is linked to a connecting rod that pushes or pulls the cam-blocks in a respective cross-machine direction to effect the height or angle adjustment of a particular foil. In this manner, the inclined planar grooves of each cam-block assist in causing a change in height or angle of the upper pultrusion assembly. An end of the lower pultrusion assembly, opposite to the actuator, is provided with an indicator means for visually observing the angle or height of the foil. This indicator may include a modified rod with measuring rings which indicate a height or angle. Otherwise, the indicator may include marks on an end plate. It should be recognized that certain modifications may be undertaken to the instant invention. For instance, a manual adjustment mechanism may be provided at one end of the lower pultrusion assembly in lieu of the motorized actuator as respectively shown in FIGS. 1A, 1C.

As it can be understood from the various drawings, the upper pultrusion assembly includes at least one ceramic surface, which is atop the upper support pultrusion assembly, referenced throughout as upper pultrusion. The upper support pultrusion typically comprises a fiberglass material or fiber reinforced material. A scraper and its associated holder are affixed onto opposite sides or faces of the upper support pultrusion assembly. Each scraper directs fluids and contaminants away from where the upper pultrusion assembles to the lower pultrusion. The upper support pultrusion assembly is formed in an elongated manner, having a complementary shape to accept the upper side of the cam-blocks such that when the cam-blocks are withdrawn to one side of the Fourdrinier, the ceramic foil is aligned at for instance either a zero height in elevation or a −1 degree angle depending on the particular height or angle adjustment application. It is should be noted that the reference points and ranges for the heights and angles may be adjusted according to user needs and that any set forth in this application should be considered for illustrative purposes and not in a limiting sense. When the cam-blocks are forced towards the side opposite the actuator, the inclined grooves of the cam-blocks communicate with guide keys fastened to the interior side of the upper support pultrusion assembly to raise the height of the ceramic foil or change the angle. If the slope of the inclined grooves of the leading and trailing edges are equal then a height adjustment mechanism may be realized. Otherwise, if the included grooves are unequal then an angle adjustment mechanism may be implemented. Raising and lowering the ceramic foil or adjusting the angle of the foil to the paper sheet manipulates the fiber alignment in the paper sheet forming process.

Two separate embodiments are realized by sloping the inclined grooves of the cam-blocks in either direction across the paper machine. That is, a height adjustable foil may be implemented by providing cam-blocks with a front and rear face having inclined grooves formed therein. The inclined grooves slope from one side to the other whilst maintaining the same degree of slope of the inclined groove on both faces. In an angle adjustment embodiment, the inclined grooves formed in the surfaces of the faces of the cam-blocks may incorporate different angled grooves and sloped as shown in the drawings. That is, an angle adjustable foil may be implemented by sloping the inclined grooves on opposite faces of the cam-blocks at different angles causing the rate of change from the front end of the foil to vary from that of the back end. This forces a larger amount of displacement on, for example, the leading edge of the foil to occur thereby allowing an operator to adjust the angle at which the edges of the foil contact the underside of the forming wire or paper sheet. By maintaining a height difference between the leading and trailing edges of the ceramic foil(s), an angle adjustable embodiment is realized.

It is an object of the invention to disclose an improved process and mechanism for controlling the angle of an adjustable angle foil to achieve a better paper quality by adjusting the angle to create a desirable result in the paper forming process.

It is another object of the invention to set forth improved processes and mechanisms for controlling the height of an adjustable height foil to achieve a better paper quality.

It is a further object of the invention to teach a Fourdrinier having adjustable on-the-run mechanisms for adjusting the height and angle of foils or blades to easily switch over operation of the Fourdrinier to produce paper of various qualities and types without shutting down and restarting the machine. This on-the-run adjustment saves substantial energy costs and realizes a more energy efficient paper producing method of the paper machine.

Additional objects and advantages of the invention will be set forth in part in the description, which follows, and in part will be obvious from the description, or may be learned from practicing the invention. The objects and advantages of the invention will be obtained by means of instrumentalities in combinations particularly pointed out in the appended claims.

BRIEF DESCRIPTION OF THE SEVERAL VIEWS OF THE DRAWING

Other objects and purposes of this invention will be apparent to a person acquainted with an apparatus of this general type upon reading the following specification and inspecting the accompanying drawings, in which.

DETAILED DESCRIPTION OF THE INVENTION

Figure 1A:
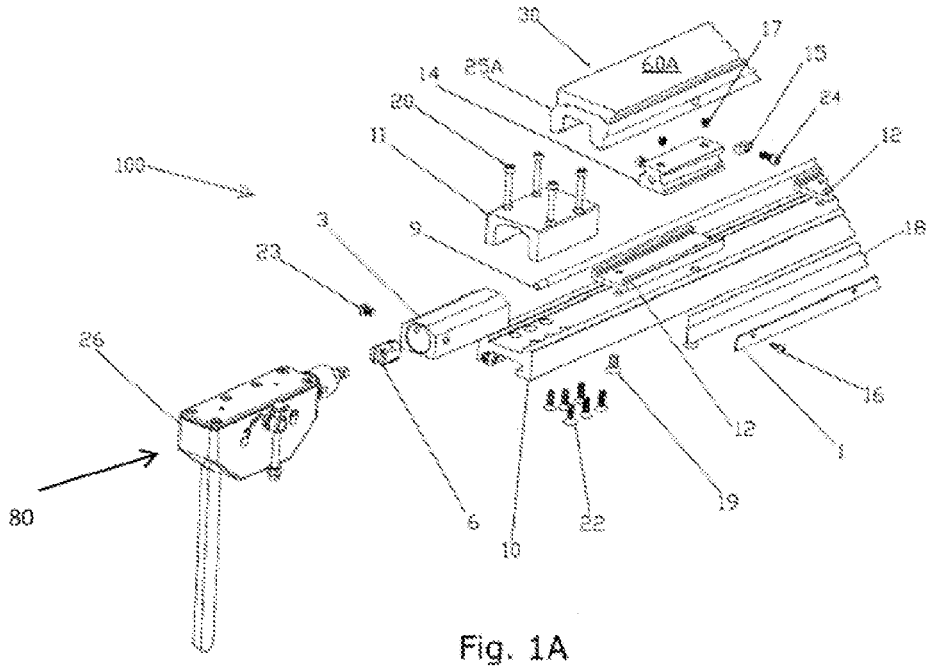
FIG. 1A illustrates a partial exploded view of a foil angle adjustment mechanism and taken from the drive end.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

For illustrative purposes only, the invention will be described in conjunction with a Fourdrinier papermaking machine although the invention and concept could also be applied to other paper forming machines. The invention is preferably implemented in the wet section of the Fourdrinier which includes a forming board section, a hydrofoil section, and a vacuum section.

As is shown in FIGS. 1A and 18, an angle adjustable device 100 includes an upper pultrusion assembly 30, an angle or height adjustment mechanism 80, and a lower pultrusion assembly 10. The height adjustable device 100 is shown in FIGS. 1A-1C, 4A-4B, 7, and corresponds to the cam-block shown in FIGS. 8A-8B. An angle adjustable device 101 is represented in FIGS. 3A-38, and corresponds to the cam-block shown in FIGS. 9A-9B. The other drawings represent parts which are in common between the height adjustable device and the angle adjustable device. Recognizable differences are shown in the drawings and include the shape of the upper pultrusions 25A, 258, the ceramic foils 60A, 60B, and the slope of the guide tracks 75A, 758, 76A, 76B. In both embodiments of the invention, the upper pultrusion 25A, 25B includes a leading edge and a trailing edge. A closed top is formed between the leading and trailing edges and includes an upper surface to which either a single ceramic foil is affixed, as in FIGS. 1A-1C or a pair of ceramics are affixed as shown in 3A, 3B. The upper and lower pultrusions may be formed using a known forming technique such as extrusion.

Figure 1B:
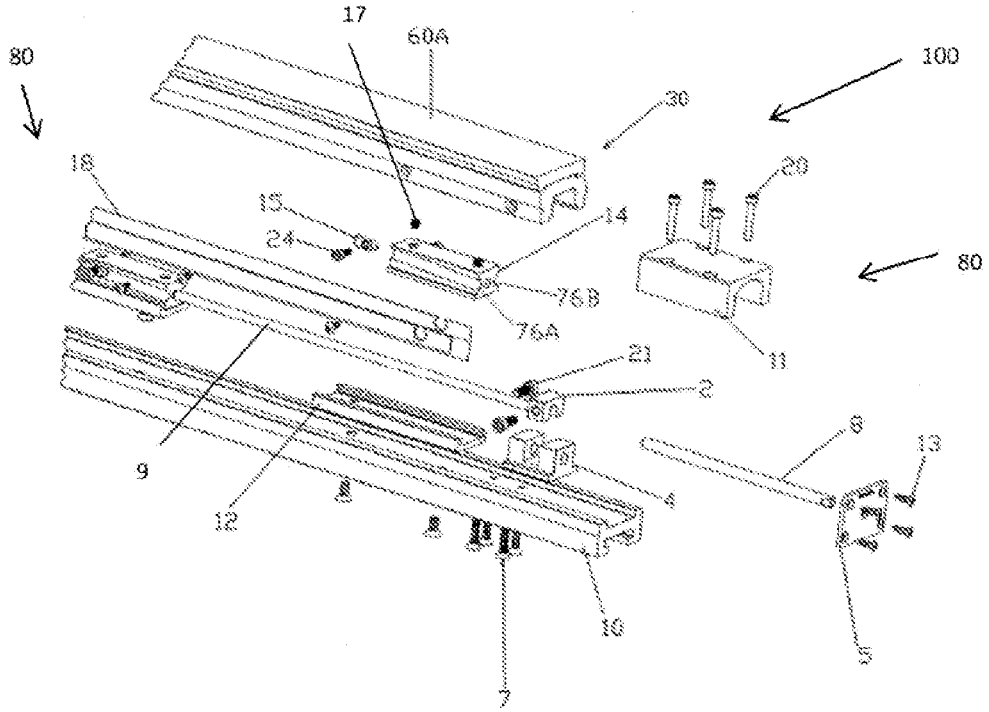
FIG. 1B illustrates a partial exploded view of the foil angle adjustment mechanism taken from an end opposite the one shown in FIG. 1A.
Figure 1C:
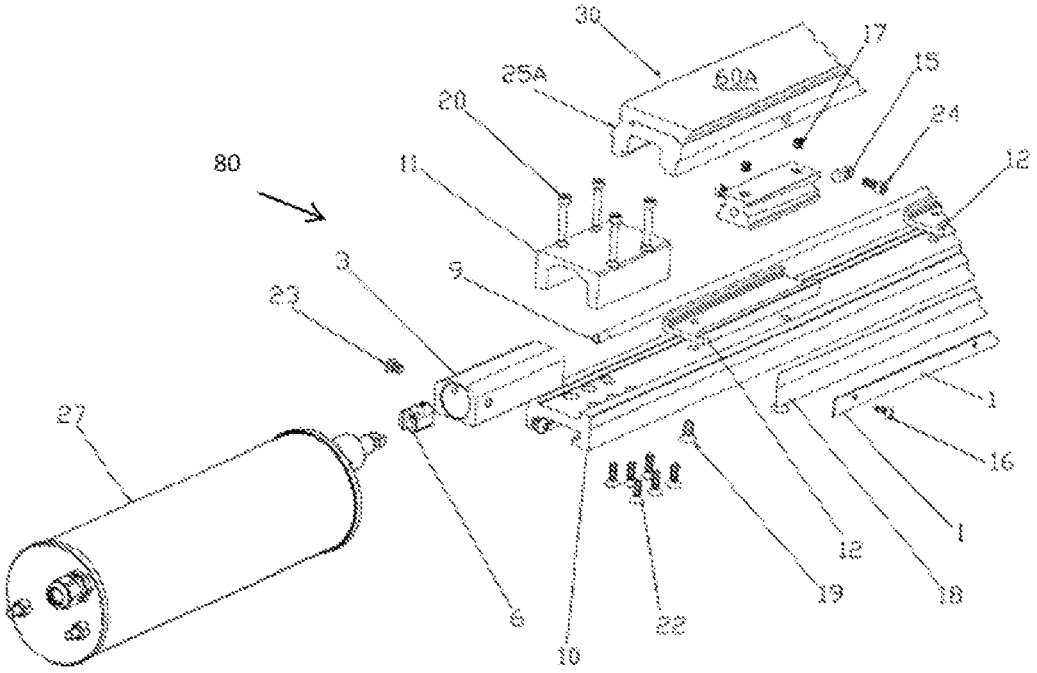
FIG. 1C shows an automated embodiment having a pneumatic or electric motor that controls either the height or angle of a foil and taken from the drive end.
Figure 3A:
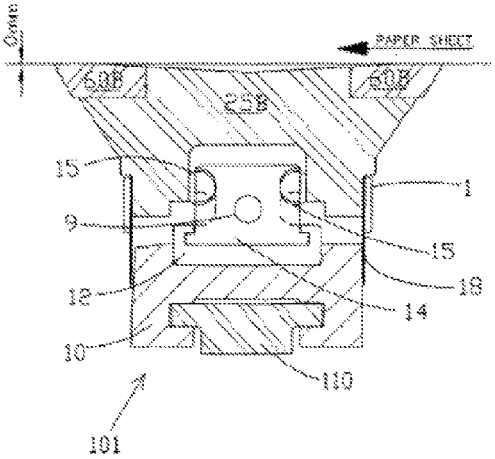
FIG. 3A shows an end view of the height adjustable embodiment taken from an end of a glide shoe and cam-block at zero mm whereby the ceramic edges of the upper pultrusion are contacting an underside of the paper forming sheet.
Figure 3B:
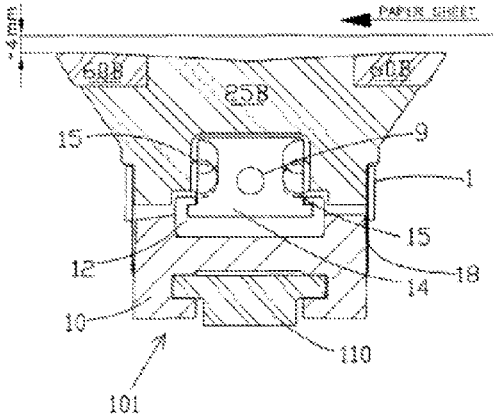
FIG. 3B shows the same end view as FIG. 3A with the height adjusted to −4 mm below the paper sheet.

In the angle adjustment embodiment, a single ceramic foil 60A is arranged atop the closed top of the upper pultrusion 25A as shown in FIGS. 1A-1C. A pair of ceramic foils 608 is arranged on opposite sides of the upper pultrusion 258 in the height adjustable embodiment as shown in FIGS. 3A-3B. The differences in shape between the upper pultrusions 25A, 25B are clearly depicted in the drawings. For instance, the exterior surface of the top of pultrusion 25A includes a flat stepped region for accommodating the recessed portion of the underside of ceramic foil 60A. In the height adjustable embodiment of FIGS. 3A-3B, the upper surface of the upper pultrusion 25B is sloped from side-to-side with a lower region formed in the exterior top and includes steps on either side for accommodating a pair of ceramic foils 60B. The ceramic foils may be fastened to the upper exterior of the upper pultrusion in a known manner. The interior workings of both upper pultrusions are the same for both the height and angle adjustable embodiments. That is, the guide keys are fastened to the interior recess of the upper pultrusions in both embodiments and adjust a respective ceramic foil's angle or height as a plurality of cam-blocks move across a plurality of glide shoes. Each guide key is maintained in an operable fashion within a respective sloped track. Sloped tracks are formed on the opposite faces of a cam-block and receive a respective guide key. A pair of guide keys are arranged substantially equidistance from an end of the upper pultrusion. Enough pairs of guide keys are arranged within the upper pultrusion to ensure accurate adjustments of either the angle or height along the entire length of the upper pultrusion.

The upper pultrusion assemblies 25A, 25B include respective ceramic surfaces 60A, 608 arranged atop the exterior of upper pultrusion support assemblies 25A, 258, as shown in FIGS. 1A-1C and FIGS. 3A, 3B, respectively. The upper pultrusion support assemblies 25A. 25B are formed of fiberglass reinforced composite and shaped in an inverted U-shape (when viewed from either end) to span across the entire width of the Fourdrinier. Upper pultrusion assembly 25A includes sloped exterior edges arranged on the leading and trailing faces with a stepped region that accepts scrapers 18 and holder 1. A scraper 18 is provided on either face of the upper pultrusion support assemblies 25A, 25B and is secured thereto via fasteners 16 and a scraper holder 1 for preventing debris, liquid, pulp, chemicals, and the like from entering into the device. Both upper pultrusion support assemblies include a stepped region on the interior of the leading and trailing faces to accommodate the glide shoes and allow the upper pultrusions to be adjusted. As can be recognized by FIGS. 3A-38 and 4A-4B, the upper exterior of the upper pultrusion includes a pair of angled edges for securing the ceramic foil atop the upper pultrusion. In the height adjustment embodiment of FIGS. 3A-3B, the angles are substantially ninety degrees; whilst in the angle adjustment embodiment of FIGS. 4A-4B, the angles are acute.

Figure 2:
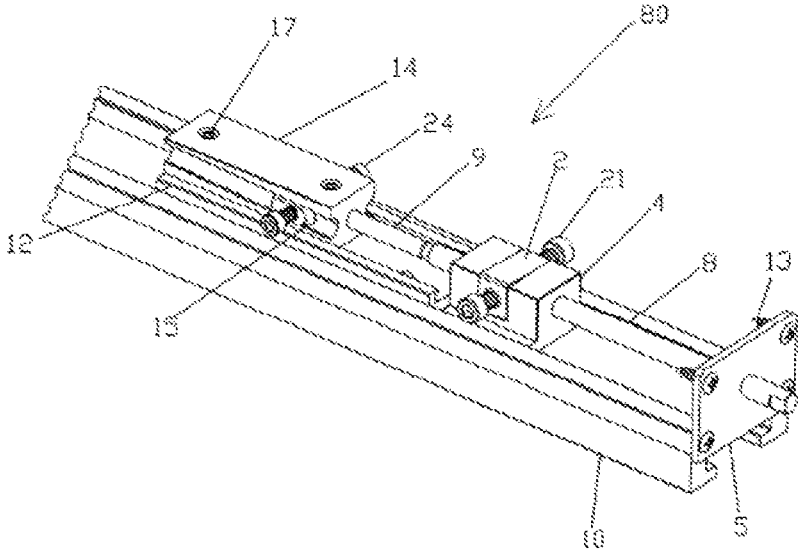
FIG. 2 is a perspective view of the constructed lower pultrusion assembly including a substantial portion of the angle or height adjustment mechanism and showing the working relationship between the guide keys and the cam-blocks.

The lower pultrusion assembly 10 is an elongated member formed to include a T-shaped recess on its underside for accepting T-bar 110 shown in FIGS. 3A, 3B, 4A, 4B. A U-shaped recess (when viewed from either end) is formed on an upper side of the lower pultrusion assembly 10. Fasteners 19 pass through a respective through opening in the lower pultrusion to secure a glide shoe 12 to a portion of the upper surface of the lower pultrusion assembly 10 within the U-shaped recess (Shown in FIG. 7). Fasteners 13 secure an end plate 5 to one end of the lower pultrusion, as is shown in FIGS. 1B and 2. End block 4 and pivot 2 are secured to a region of the upper surface of the lower pultrusion assembly 10 via fasteners 7, as shown in FIG. 18. FIG. 1A depicts a manual actuator 26 and FIG. 1C illustrates an automatic actuator such as motor 27 is adapted to the upper side of the lower pultrusion assembly 10 and is arranged at an opposite end of the lower pultrusion assembly 10 to end plate 5 (shown in FIG. 18B). The angle or height adjustment mechanism 80 as shown in FIG. 1B includes the glide shoes 12, the end block 4, drive adapter 3 (shown in FIG. 1B), pivot 2, cam-blocks 14, connecting rod 9, actuator 26 (shown in FIG. 1A) or motor 27 (shown in FIG. 1C), end plate 5 and the guide keys 15, as well as any associated respective fasteners.

The manual gear box 26 may be provided in place of the motor 27 for manually adjusting the height or angle of the foil, as shown in FIG. 1A and FIG. 1C respectively. The manual gear box 26 includes a handle and locking mechanism. A coupler 6 transmits torque from either the motor 27 or manual gear box 26 through the drive adapter 3 and onto the connecting rod 9. Drive adapter 3 supports an end of connecting rod 9 and driver adapter 3 within a recess as shown in FIGS. 1A-1C. Linear movement of the connecting rod 9 is transmitted to move the cam-blocks 14 across the glide shoes 12 thereby adjusting either the height or angle of the foil by causing the guide keys 15, which are affixed to an interior surface of the upper pultrusion to rise and fall. Drive adapter 3 is formed with a yoke that accepts an end of the manual gear box 26 (actuator) or motor 27. The overall shape of the drive adapter is cylindrical to fit into a cylindrical recess formed in an end of drive adapter 3. Drive adapter 3 is elongated and includes a flat top having sloped edges on either side thereof. An end of connecting rod 9 extends into the end of the drive adapter 3 opposite the recess. The glide shoes 12 provide a reduced friction surface over which the cam-blocks 14 move to easily adjust the height or angle of the foil. Set screws 17 pass through openings in the upper surface of the cam-blocks to lock cam block 14 onto the connecting rod 9. Guide keys 15 are fastened to the interior vertical sides of the upper pultrusion via threaded fasteners 24 to moveably mate with the sloped surfaces of a respective cam-block 14 such that lateral movement of the connecting rod is transmitted to the cam-blocks which in turn adjusts the height or angle of the upper pultrusion. The guide keys 15 are operationally arranged within the sloped grooves on the sides of the cam-blocks 14 such that as the cam-blocks 14 slide across the glide shoes 12, the upper pultrusion is raised, lowered or angle adjusted with respect to a forming fabric or wire and the paper sheet. The guide keys are arranged in pairs. Each pair includes one guide key on the interior surface of the leading edge and the other guide key on the trailing edge of the upper pultrusion. The pairs of guide keys are arranged at predetermined distances.

The number of pairs of guide keys necessary for implementing either embodiment of the invention will vary according to the width of the particular Fourdrinier and the length of the pultrusions necessary to span that length. Each pair is preferably spaced at uniform distance from its preceding and/or succeeding pair and/or one of the ends of the device along the interior of the upper pultrusion. The guide keys are conical in shape with a flat side and include a pointed end. A through opening is provided in the flat side of each guide key for receiving a threaded end of a fastener 24 that couples the guide key to the upper pultrusion.

End seals 11 are arranged between the "upper pultrusion" 25 and "lower pultrusion" 10 at opposite ends thereof and fastened there between via fasteners 20 (FIGS. 1A-1C). The end seals 11 include a complementary shape to receive drive adapter 3 and pivot 2 or end block 4 as shown. A plurality of through openings are provided in each end seal for accommodating fasteners 20 which couple the respective end seal to the upper surface of the lower pultrusion. The end seals serve a similar function to that of the scrape in preventing debris, pulp, water and the like from entering the device at the ends. Fasteners 21 couple pivot 2 to end block 4 at an end of the lower pultrusion 10 opposite the drive end, as shown in FIG. 2. Pivot 2 is includes a fastener opening with an open bottom for receiving an end of a connecting rod to provide support therefor. End block 4 includes a flat bottom and vertical sides which form a yoke and having openings in both sides for receiving an end of the connecting rod and an end of the indicator rod 8 as is shown in FIG. 1B. Pivot 2 rests inside the yoke and operably couples the connecting rod and indicator rod together. One end of the connecting rod extends into the pivot 2 and end block 4, whilst an end of an indicator rod 8 extends from an opposite side of the pivot 2 and end block 4. The position of indicator rod is controlled by the connecting rod 9 such that an operator can determine either the height or angle of the foil from an end of the assembly opposite the drive end. Fasteners 22 couple drive adapter 3 to an upper surface of the lower pultrusion 10. Fastener 23 fixes couple 6 within drive adapter 3.

Each cam-block 14 includes a pair of sloped grooves on either its face or side as clearly shown in FIGS. 2, 8A-8B, 9A-9B. The underside of the lower pultrusion assembly includes a T-shaped recess into which a T-bar, mounted atop the Fourdrinier, is inserted. It should be noted that a certain C-shaped channel may be utilized in place of the T-bar for securing the lower pultrusion assembly to the top of the Fourdrinier. The T-bar and C-shaped channel is preferably formed from stainless steel and rests atop the frame of the Fourdrinier. Seals are arranged at opposite ends of the devices and prevent debris from clogging the adjustment mechanisms. The indicator rod may comprise a hollow end into which the end of the connecting rod may be seated to couple the two together.

The motor 27 may be controlled via motor control circuitry or a programmable microprocessor, not shown. As can be understood by the skilled artisan when viewing FIGS. 1A-B, 2, the actuator is fixed to the lower pultrusion assembly to push or pull the sliding cam-blocks across the low friction glide shoes to engage the sloped grooves of the cam-blocks with the keys inside the recess on the underside of the upper pultrusion assembly. The term "low friction" means a reduced friction surface that allows the cam-block to easily slide from side-to-side within the enclosure created by the upper recess of the lower pultrusion and the recess of the upper pultrusion. A connecting rod 9 connects the various cam-blocks together. As can be understood by FIGS. 1A-1C, 2, the cam-blocks are fastened via fasteners 17 at predetermined intervals along the length of the connecting rod. The angle or height of the ceramic surface is changed as the cam blocks with their sloped grooves move over the glide shoes and raise or lower the upper pultrusion assembly. As can be understood by the skilled artisan, a plurality of cam-blocks and glide shoes may be arranged across a particular lower pultrusion assembly to ensure uniform adjustment of the entire ceramic foil. The indicator rod 8 extends through the end plate 5 and visually indicates a position of the angle or height on an end opposite the actuator.

FIGS. 3A-38 show a height adjustable mechanism. The phantom lines in FIGS. 3A-3B, 4A-4B depict the sloped portion of the groove not in use. In FIG. 3A, the connecting rod is withdrawn and the ceramic foil assumes height of zero mm with respect to the underside surface of a forming fabric or the like. In FIG. 3B, the actuator extends the connecting rod to drive the cam-blocks across the glide shoes causing the upper pultrusion assembly and foil to be lowered to a height of −4 mm. As can be recognized, the upper pultrusion assembly is attached to the guide keys which communicate with the sloped edges of the cam-blocks and the height or angle of the ceramic foil is varied when the cam-blocks are driven via the connecting rod in a first direction. The upper pultrusion assembly returns to its initial state when the connecting rod is driven in a direction opposite the first direction. Thus, the height of the foil blade with respect to a forming fabric is easily changed. FIGS. 8A, 8B show the particular cam block 14 for use in the height adjustment embodiment. In this instance, the slope of grooves 75A, 75B are equal to cause the leading and trailing faces of the upper pultrusion 25B to uniformly be raised or lowered as the cam-block 14 moves across the glide shoe 12. The shape of the upper pultrusion 25B includes a stepped region on either side that extends outward to provide an overhang over the upper edges of the scraper 18 and scraper holder 1. This overhang advantageously drains materials away from the opening between the upper and lower pultrusions which is covered by the scraper 18. A sloped edge is provide on each of the faces and terminates beneath the ceramics 60B which are arranged in a shelf formed in the upper edge of the upper pultrusion 25B. The top of the upper pultrusion is sloped between the two shelves as shown in FIGS. 3A-3B.

Figure 4A:
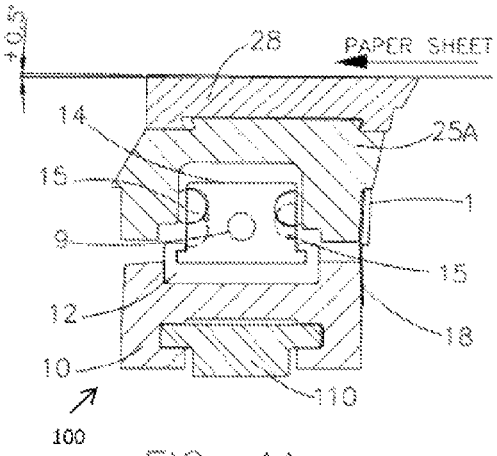
FIG. 4A shows an end view of the angle adjustable embodiment taken from an end of a glide shoe and cam-block and with a trailing edge of the ceramic foil at +0.5 degree.
Figure 4B:
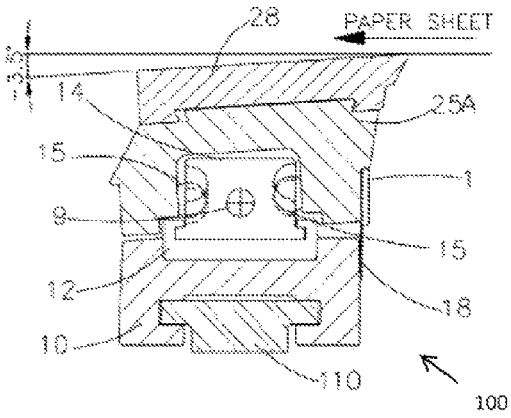
FIG. 4B shows the same end as FIG. 4A with the angle adjusted to −3.5 degrees.
Figure 9A:
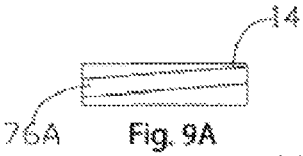
FIG. 9A is an elevated plan view of the leading edge of a cam-block in the angle adjustment embodiment of the invention.
Figure 9B:
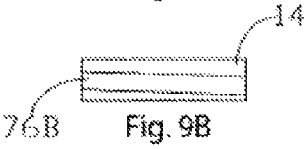
FIG. 9B is an elevated plan view of the trailing edge of the cam-block shown in FIG. 9A.

FIGS. 4A-4B show an angle adjustable mechanism. In FIG. 4A, the connecting 9 rod is withdrawn and the angle adjustable foil blade assumes a +0.5 degree. When energized, the actuator pushes the cam-blocks 14 across the glide shoes 12 such that the sloped grooves change the angle to −3.5 degrees. FIGS. 9A-9B, depict the slope angle of the grooves 76A, 768 on opposite sides of the cam-blocks being unequal, thus the angle of the ceramic foil with respect to the forming fabric may be varied. As can be understood by the skilled artisan, in the preferred embodiment, the sloped grooves of the cam-blocks are externally arranged and extend from either side-to-side or end-to-end. Likewise, certain modifications of the cam-blocks may be realized by arranging the sloped surfaces on an interior recess of the cam-blocks and the connecting rod may be driven into these sloped grooves to cause the change in either height or angle, respectively. Upper pultrusion 25A includes a stepped region on the inner lower surface for accommodating the upper surface of the glide shoe. A stepped region is also provided on opposite edges as in the alternative embodiment. A scraper and its associated holder is provided on the leading edge of the upper pultrusion 25A. A sloped region with a thicker upper edge over extends above the scraper and holder. A sloped edge also extends below the ceramic foil 28. The upper surface of the upper pultrusion includes a track comprising sloped sides and onto which the ceramic foil 28 attaches.

Figure 5A:
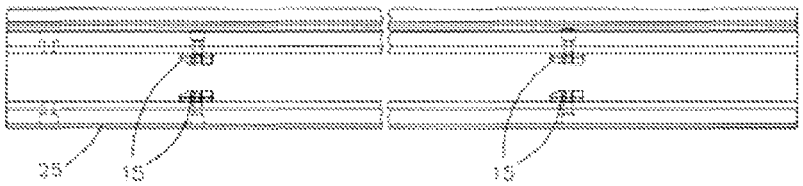
FIG. 5A shows a bottom view of the upper pultrusion assembly in an angle adjustable embodiment.
Figure 5B:
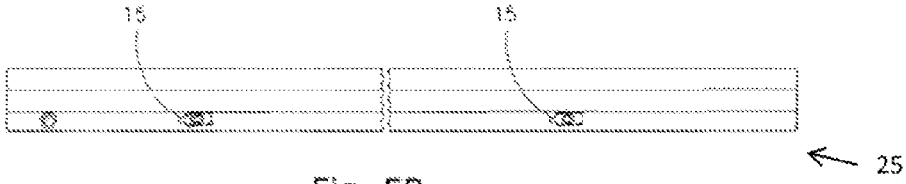
FIG. 5B is a side or edge view of the upper pultrusion assembly.
Figure 5C:
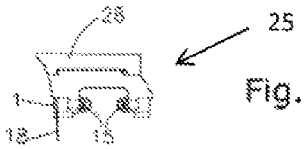
FIG. 5C is an end view of the upper pultrusion assembly.

FIGS. 5A-5C show the respective views of the upper pultrusion assembly 25 and with a more clear view of the guide keys 15 in relation to the foil 28. These drawings when viewed in connection with FIG. 2 show the unique operating relationship between the upper and lower pultrusions. As can be recognized, the cam-blocks 14 move laterally across the glide shoes 12. The guide keys 15 operationally mate with the sloped grooves on opposite sides of the cam-blocks to effect either a height change or an angle change of the ceramic foil with respect to a forming fabric.

Figure 6A:
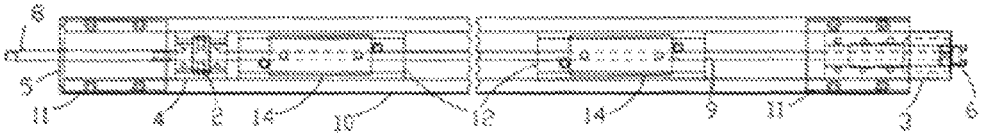
FIG. 6A shows an overhead view of the lower pultrusion assembly.
Figure 6B:
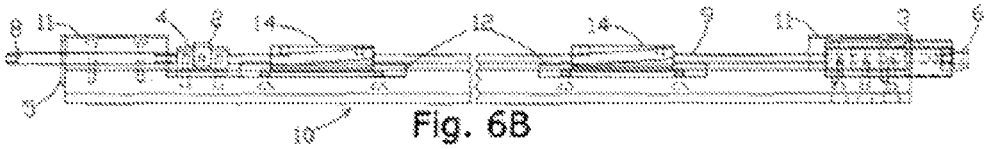
FIG. 6B shows a side view of the lower pultrusion assembly taken from an edge of the glide shoe and cam-block.
Figure 6C:
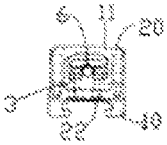
FIG. 6C is an end view of the lower pultrusion assembly.

FIGS. 6A-6C show the lower pultrusion 10 and the relationship of the connecting rod 9 to the cam-blocks 14 and other associated parts. A plurality of the cam-blocks 14, guide keys 15 (not shown), glide shoes 12, and the connecting rod 9 are arranged across the entire mechanism to ensure uniform adjustments across the entire upper face of the ceramic.

Figure 7:
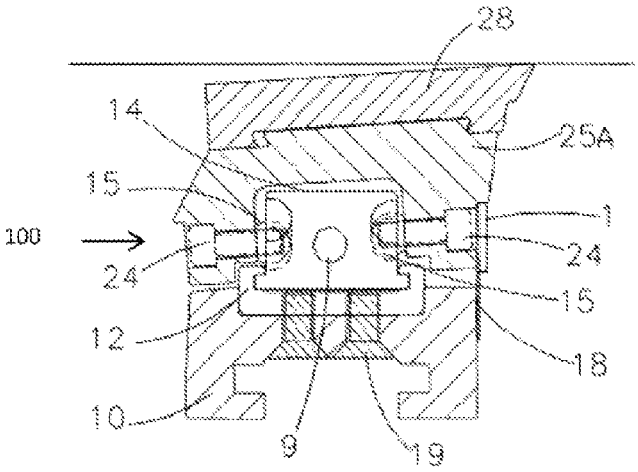
FIG. 7 is a section view of the foil adjustment mechanism in an angle adjustment embodiment.
Figure 8A:
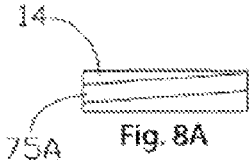
FIG. 8A is an elevated plan view of the leading edge of a cam-block in the height adjustment embodiment of the invention.
Figure 8B:
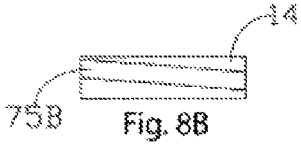
FIG. 8B is an elevated plan view of the trailing edge of the cam-block shown in FIG. 8A.

FIG. 7 is a cross section view of the mechanism and showing the various locations of the guide key 15 as the cam-blocks 14 are slid across the guide shoes 12. As can be recognized, the guide keys 15 are raised or lowered via the sloped grooves on the sides of the cam-blocks 14.

It should be understood that it is contemplated that various other drives, pistons or motors including electric and hydraulic ones and their associated supply lines may be employed to practice the invention. In the height adjustment device, the adjustable blades are raised or lowered to cause them to intersect with the underside of the forming fabric at a predetermined height to influence the alignment of the fibers within the paper web. The height of the adjustable blades may be changed to ensure that the paper fibers are aligned in a desired direction. As can be understood, changing the height settings will directly influence the fiber orientation in the paper sheet. Likewise, the angle of certain foils may be adjusted according to a desired characteristic in the paper grade. Moreover, the quantity of parts may vary according to the length of the foil.

It is to be understood that the invention is not limited to the exact construction illustrated and described above, but that various changes and modifications may be made without departing from the spirit and the scope of the invention as defined in the following claims. While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

We claim:

1. An adjustment mechanism for controlling a height or an angle of a ceramic foil, the adjustment mechanism comprising:

an upper pultrusion having:

a first end, a second end located opposite the first end, an open bottom, a leading face, and a trailing face connected to and located opposite the leading face by a closed top forming a recess in the upper pultrusion, wherein the ceramic foil is arranged on an exterior of the closed top of the upper pultrusion, and wherein a plurality of pairs of guide keys arranged on an interior surface of the upper pultrusion along the leading face and the trailing face;

a lower pultrusion having:

a first end, a second end, and an upper recess being arranged beneath the recess of the upper pultrusion, and said lower pultrusion having a bottom recess that receives a support of a paper machine, wherein the lower pultrusion movably connects the upper pultrusion to the support;

a plurality of glide shoes having an upper surface and being fastened within the upper recess of the lower pultrusion;

an actuator arranged at the first end of the lower pultrusion and which adjusts either a height or angle of the ceramic foil when actuated;

a connecting rod having one end coupled to the actuator and an opposite end coupled to an indicator, so that actuation of the actuator extends and retracts the connecting rod between the first end and the second end of the upper pultrusion and the lower pultrusion; and a plurality of cam-blocks having:

a first end, a second end, a leading face, and a trailing face, and wherein each cam block is arranged atop one of the glide shoes of the plurality of glide shoes, wherein said cam block includes:

a sloped groove with an open side provided on the leading face, a sloped groove with an open side provided on the trailing face, and a through opening extending from the first end to the second end of the cam-block and having the connecting rod passing through the through opening and fasteners fastening the cam-block to the connecting rod, one of the guide keys of one of the pairs of the plurality of guide keys being arranged within each of the sloped grooves so movement of the plurality of cam blocks relative to the plurality of guide keys adjusts the height or the angle of the ceramic foil.

2. The adjustment mechanism for controlling a height or angle of a ceramic foil of claim 1, wherein the adjustment mechanism includes an actuator coupler having a first end that defines a recess and a second end into which an end of the connecting rod is arranged, said actuator being fastened within the upper recess of the lower pultrusion; and a drive adapter having a first end that comprises a recess which accepts an end of the actuator, said drive adapter arranged within the recess of the actuator coupler to transmit movement from the actuator to the connecting rod.

3. The adjustment mechanism for controlling a height or angle of a ceramic foil of claim 1, wherein the adjustment mechanism includes a first scraper fastened onto the leading edge of the upper pultrusion by a first scraper holder; and, a second scraper fastened onto to the trailing edge of the upper pultrusion by a second scraper holder.

4. The adjustment mechanism for controlling a height or angle of a ceramic foil of claim 1, wherein the adjustment mechanism includes a first end seal arranged at the first end of the upper pultrusion and the lower pultrusion; and, a second end seal arranged at the second end of the upper pultrusion and the lower pultrusion.

5. The adjustment mechanism for controlling a height or angle of a ceramic foil of claim 1 wherein the upper pultrusion and the lower pultrusion are formed from fiberglass.

6. The adjustment mechanism for controlling a height or angle of a ceramic foil of claim 5, wherein the adjustment mechanism includes a first end seal arranged at the first end of the upper and lower pultrusions; and, a second end seal arranged at the second end of the upper and lower pultrusions.

7. The adjustment mechanism for controlling a height or angle of a ceramic foil of claim 1 further comprising:

an end block having two vertical sides forming a yoke and being arranged on the upper recess of the lower pultrusion and at the second end of the lower pultrusion;

a pivot arranged within the yoke of the end block; and, an end plate fastened at the second end of the lower pultrusions.

8. The adjustment mechanism for controlling a height or angle of a ceramic foil of claim 7, wherein the adjustment mechanism includes an actuator coupler having a first end that defines a recess and a second end into which an end of the connecting rod is arranged, said actuator being fastened within the upper recess of the lower pultrusion; and, a drive adapter having a first end that comprises a recess which accepts an end of the actuator, said drive adapter arranged within the recess of the actuator coupler to transmit movement from the actuator to the connecting rod.

9. The adjustment mechanism for controlling a height or angle of a ceramic foil of claim 7, wherein the adjustment mechanism includes a first scraper fastened onto the leading edge of the upper pultrusion by a first scraper holder; and, a second scraper fastened onto to the trailing edge of the upper pultrusion by a second scraper holder.

10. The adjustment mechanism for controlling a height or angle of a ceramic foil of claim 9, wherein a slope of the sloped groove with an open side provided on the leading face is equal to a slope of the sloped groove with an open side provided on the trailing face.

11. The adjustment mechanism for controlling a height or angle of a ceramic foil of claim 9 wherein a slope of the sloped groove with an open side provided on the leading face is unequal to a slope of the sloped groove with an open side provided on the trailing face.

12. The adjustment mechanism for controlling a height or angle of a ceramic foil of claim 1 wherein said actuator is a manual gearbox.

13. The adjustment mechanism for controlling a height or angle of a ceramic foil of claim 1 wherein said actuator is one of an electric, hydraulic, and pneumatic motor.

14. The adjustment mechanism for controlling a height or angle of a ceramic foil of claim 1 wherein a slope of the sloped groove with an open side provided on the leading face is equal to a slope of the sloped groove with an open side provided on the trailing face.

15. The adjustment mechanism for controlling a height or angle of a ceramic foil of claim 14, wherein the adjustment mechanism includes an end block having two vertical sides forming a yoke and being arranged on the upper recess of the lower pultrusion and at the second end of the lower pultrusion;

a pivot arranged within the yoke of the end block; and, an end plate fastened at the second end of the lower pultrusion.

16. The adjustment mechanism for controlling a height or angle of a ceramic foil of claim 15, wherein said actuator is a manual gearbox.

17. The adjustment mechanism for controlling a height or angle of a ceramic foil of claim 16, wherein said actuator is one of an electric, hydraulic, and pneumatic motor.

18. The adjustment mechanism of claim 15, wherein the adjustment mechanism includes an actuator coupler having a first end that defines a recess and a second end into which an end of the connecting rod is arranged, said actuator being fastened within the upper recess of the lower pultrusion; and, a drive adapter having a first end that comprises a recess which accepts an end of the actuator, said drive adapter arranged within the recess of the actuator coupler to transmit movement from the actuator to the connecting rod.

19. The adjustment mechanism of claim 18, wherein the adjustment mechanism includes a first scraper fastened onto the leading edge of the upper pultrusion by a first scraper holder; and, a second scraper fastened onto to the trailing edge of the upper pultrusion by a second scraper holder.

20. The adjustment mechanism of claim 19, wherein the adjustment mechanism includes a first end seal arranged at the first end of the upper and lower pultrusions; and, a second end seal arranged at the second end of the upper and lower pultrusions.

21. The adjustment mechanism of claim 20, wherein the upper and lower pultrusions are formed from fiberglass.

22. The adjustment mechanism of claim 21, further comprising:

an end block having two vertical sides forming a yoke and being arranged on the upper recess of the lower pultrusion and at the second end of the lower pultrusion;

a pivot arranged within the yoke of the end block; and, an end plate fastened at the second end of the upper and lower pultrusions.

23. The adjustment mechanism for controlling a height or angle of a ceramic foil of claim 1 wherein a slope of the sloped groove with an open side provided on the leading face is unequal to a slope of the sloped groove with an open side provided on the trailing face.

24. The adjustment mechanism for controlling a height or angle of a ceramic foil of claim 1 wherein the upper and lower pultrusions are formed from fiberglass.

25. The adjustment mechanism for controlling a height or angle of a ceramic foil of claim 1, wherein the plurality of cam blocks move between the upper pultrusion and the lower pultrusion so that the height or angle of the ceramic foil connected to the upper pultrusion is changed.

26. An adjustment mechanism for controlling a height or angle of a ceramic foil comprising:

an upper pultrusion having:

a first end, a second end opposite the first end, an open bottom, and a leading face and a trailing face connected together by a dosed top creating a recess within the upper pultrusion, wherein the ceramic foil is arranged on an exterior of the closed top of the upper pultrusion, and a plurality of pairs of guide keys, one of each pair of guide keys being arranged on an interior surface of the upper pultrusion along the leading face and the other of each pair of guide keys being arranged on an interior surface of the trailing face;

a lower pultrusion having:

a first end, a second end located opposite the first end, and an upper recess, wherein the lower pultrusion is arranged beneath the upper pultrusion;

a plurality of glide shoes having a low friction upper surface and being fastened atop the lower pultrusion within the upper recess of the lower pultrusion;

an actuator arranged at the first end of the lower pultrusion, which adjusts either a height or angle of the ceramic foil when actuated;

a plurality of cam-blocks having;

a leading face, a trailing face opposite the leading face, and a through opening extending from a first end to a second end that is opposing the first end, wherein each cam-block is arranged atop a glide shoe of the plurality of glide shoes, wherein each of the cam blocks include a sloped groove provided on the leading face, and a sloped groove provided on the trailing face, one of the guide keys of the plurality of pairs of guide keys being arranged within each of the sloped grooves such that height or angle adjustments are made to the ceramic foil when the cam-blocks slide across the respective glide shoes;

one connecting rod connected at one end to the actuator and extending through each cam-block to translate movement of the actuator to the plurality of cam-blocks to adjust either the height or angle of the ceramic foil;

an actuator coupler having a first end that defines a recess and a second end into which an end of the connecting rod is arranged, said actuator being fastened within the upper recess of the lower pultrusion;

a drive adapter having a first end that comprises a recess which accepts an end of the actuator, said drive adapter arranged within the recess of the actuator coupler to transmit movement from the actuator to the connecting rod;

a first scraper fastened onto the leading edge of the upper pultrusion by a first scraper holder;

a second scraper fastened onto to the trailing edge of the upper pultrusion by a second scraper holder;

a first end seal arranged at the first end of the upper and lower pultrusions;

a second end seal arranged at the second end of the upper and lower pultrusions;

an end block having two vertical sides forming a yoke and being arranged on the upper recess of the lower pultrusion and at the second end of the lower pultrusion;

a pivot arranged within the yoke of the end block; and, an end plate fastened at the second end of the lower pultrusion.

27. The adjustment mechanism for controlling a height or angle of a ceramic foil of claim 26, wherein the upper pultrusion and the lower pultrusion are formed from fiberglass.

28. The adjustment mechanism of claim 26, wherein said actuator is a manual gearbox.

29. The adjustment mechanism of claim 26, wherein said actuator is one of an electric, hydraulic, and pneumatic motor.

30. The adjustment mechanism of claim 26, wherein a slope of the sloped groove with an open side provided on the leading face is equal to a slope of the sloped groove with an open side provided on the trailing face.

31. The adjustment mechanism of claim 26, wherein a slope of the sloped groove with an open side provided on the leading face is unequal to a slope of the sloped groove with an open side provided on the trailing face.

32. The adjustment mechanism for controlling a height or angle of a ceramic foil of claim 26, wherein the plurality of cam blocks move between the upper pultrusion and the lower pultrusion so that the height or angle of the ceramic foil connected to the upper pultrusion is changed.

* * * * *